United States Patent [19]

Ito et al.

[11] 4,136,645

[45] Jan. 30, 1979

[54] ELECTRIC AIR-TO-FUEL RATIO CONTROL SYSTEM

[75] Inventors: Osamu Ito, Toyota; Nobuhito Hobo, Inuyama; Yutaka Suzuki, Nishio; Itsushi Kawamoto, Ohiryu; Takashi Naitou, Kariya; Makoto Shiozaki, Toyota; Yoshimune Konishi, Kariya, all of Japan

[73] Assignee: Nippondenso Co., Ltd., Kariya, Japan

[21] Appl. No.: 795,910

[22] Filed: May 11, 1977

[30] Foreign Application Priority Data

Jun. 15, 1976 [JP] Japan ..... 51-70847

[51] Int. Cl.[2] ..... F02B 3/08; F02M 7/12; F01N 3/08

[52] U.S. Cl. ..... 123/32 EE; 123/32 EA; 123/119 EC; 60/276; 60/285

[58] Field of Search ..... 123/119 EC, 119 EA, 123/119 EE; 60/276, 285

[56] References Cited

U.S. PATENT DOCUMENTS

| | | | |
|---|---|---|---|
| 3,636,931 | 1/1972 | Suda | 123/32 EA |
| 3,745,768 | 7/1973 | Zechnall et al. | 60/285 |
| 3,861,366 | 1/1975 | Masaki et al. | 123/119 EC |
| 3,875,907 | 4/1975 | Wessel et al. | 123/32 EE |
| 4,046,118 | 9/1977 | Aono | 123/32 EE |

FOREIGN PATENT DOCUMENTS

| | | | |
|---|---|---|---|
| 2622836 | 1/1977 | Fed. Rep. of Germany | 123/32 EE |

*Primary Examiner*—Charles J. Myhre
*Assistant Examiner*—P. S. Lall
*Attorney, Agent, or Firm*—Cushman, Darby & Cushman

[57] ABSTRACT

A function signal having a desired characteristic curve is generated through the logical operation on a vehicle speed signal indicative of the speed of a vehicle, a ratio signal indicative of the air-to-fuel of the mixture supplied to the engine mounted on the vehicle, and a pressure signal indicative of the pressure in the intake manifold of the engine. The position of an electromagnetic valve for adjusting the amount of fuel supplied to the engine is controlled in response to the function signal, thereby controlling the air-to-fuel of mixtures in accordance with the various driving conditions of the vehicle including the vehicle speed.

9 Claims, 22 Drawing Figures

ELECTRIC AIR-TO-FUEL RATIO CONTROL SYSTEM

BACKGROUND OF THE INVENTION

1. FIELD OF THE INVENTION

The present invention relates to air-to-fuel ratio control systems, and more particularly the invention relates to a control system for electrically controlling the air-to-fuel ratio of the mixture produced in the carburetor of an internal combustion engine for automobiles.

2. DESCRIPTION OF THE PRIOR ART

Conventional internal combustion engines for automobiles have been so constructed that the weight ratio between the amount of intake air and the amount of fuel to be mixed, i.e. the air-to-fuel ratio of the mixture produced in the carburetor is controlled in accordance with a few engine operating conditions such as the throttle opening and the amount of intake air. However, with a recent tendency toward cleaner exhaust emissions, the demand for reduction in fuel consumption necessitated by a recent steep rise in the price of gasoline, etc., increasingly complicated air-to-fuel ratio controlling characteristics are required for the carburetors, and moreover there also exists a need for highly accurate air-to-fuel ratio control.

On the other hand, the driver of an automobile carrying an internal combustion engine requires, as the essential requisites for the driving of his vehicle, that the driver can drive his vehicle at any desired speed, and that improved driveability in terms of acceleration performance, etc., is ensured. In view of the fact that the vehicle speed has an important bearing on the needs of the society, i.e., cleaner exhaust emissions and reduced fuel consumption, it should be appreciated that the speed of the automotive vehicle among vehicle driving conditions is an important control parameter for the internal combustion engine mounted on the vehicle. However, none of prior art systems have regarded it as important.

SUMMARY OF THE INVENTION

With a view to meeting these requirements, it is the object of this invention to provide an electric air-to-fuel ratio control system which is capable of controlling, in accordance with the driving conditions of an automotive vehicle including its speed, the air-to-fuel ratio of the mixture produced in the carburetor of the internal combustion engine mounted on the vehicle.

In a preferred embodiment shown herein, the system of this invention comprises driving condition detecting means including a vehicle speed detector, and a function voltage generator which determines a desired air-to-fuel ratio to be controlled by utilizing the detected driving conditions as control parameters. The air-to-fuel ratio of the mixture supplied to the engine is controlled in accordance with the function voltage, thereby controlling the air-to-fuel ratio of the mixture produced in the carburetor in accordance with the driving conditions including the vehicle speed and a driving condition as detected by detecting means. In accordance with this invention, the air-to-fuel ratio of the mixture supplied to a vehicle mounted internal combustion engine for automobiles is controlled at a value suitable for exhaust emission control purposes in the low speed range of the vehicle, while in the intermediate and high speed ranges of the vehicle where there is no particular need to control exhaust emissions, either fuel economy operation or high power output operation of the engine is accomplished in accordance with the driving conditions of the vehicle, thus realizing an air-to-fuel ratio control which is capable of meeting the requirements of the engine under various driving conditions of the vehicle.

DESCRIPTION OF THE PREFERRED EMBODIMENTS

The present invention will now be described in greater detail with reference to the accompanying drawings.

Figure 1:
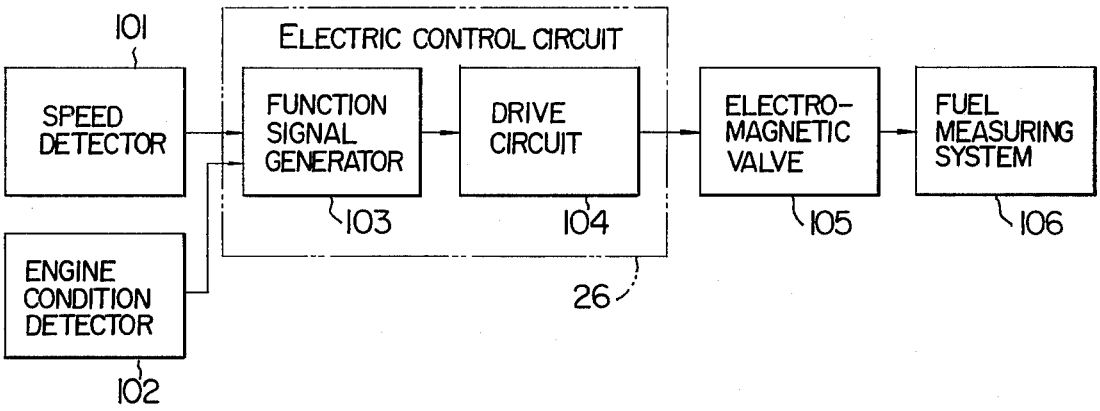
FIG. 1 is a block diagram showing the construction of an electric air-to-fuel ratio control system according to an embodiment of the invention.

Referring first to FIG. 1, there is illustrated a block diagram of an embodiment of this invention. In the FIG. 1, numeral 101 designates a vehicle speed detector which is capable of detecting the speed of a vehicle by detecting the rotational speed of the driving shaft leading from the transmission output shaft to the axles, the speedometer cable or the like. Numeral 102 designates a detector for detecting a driving condition other than the vehicle speed, e.g., a detector for detecting an engine operating condition such as the pressure in the intake manifold. Numeral 26 designates an electric control circuit comprising a function voltage generator 103 and a drive circuit 104. The function voltage generator 103 utilizes the detection signals generated from the driving condition detectors 101 and 102 as control parameters for generating a function voltage to determine a target value for the carburetor air-to-fuel ratio control. Numeral 105 designates an electromagnetic valve constituting adjusting means, and the drive circuit 104 converts the function voltage into a drive voltage which is suitable for the control method of the electromagnetic valve 105. The electromagnetic valve 105 is a flow control actuator for varying the passage area of a fuel measuring system 106 such as the fuel passage, air bleed or the like of the carburetor in response to the drive voltage, thereby controlling the air-to-fuel ratio of the mixtures sucked into the engine.

Figure 2:
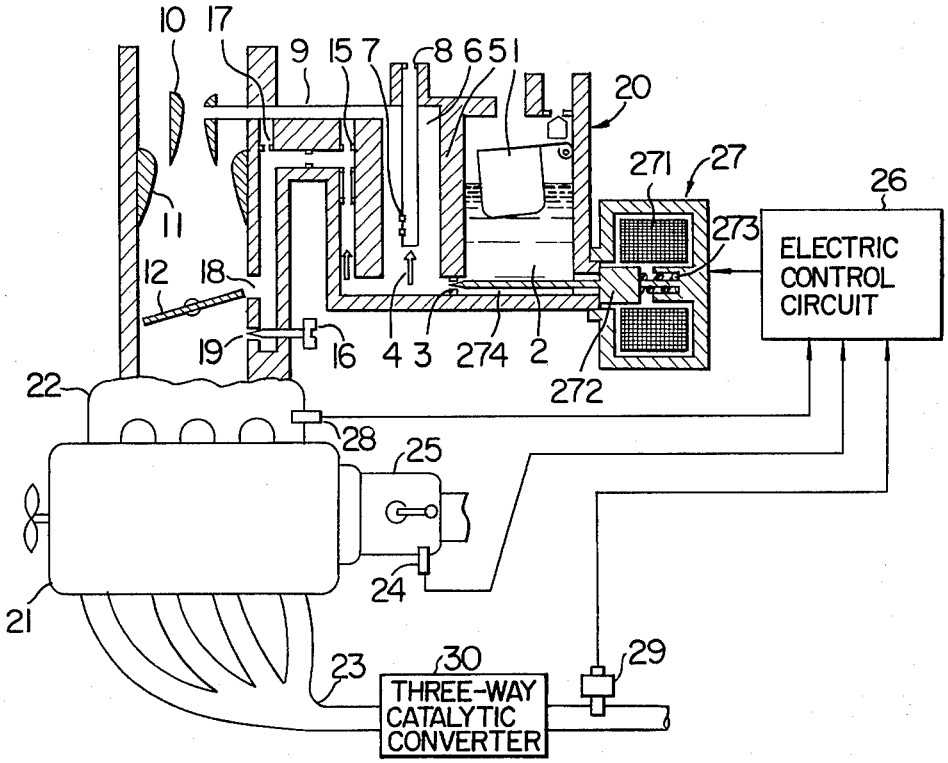
FIG. 2 is a partial sectional schematic diagram showing the principal mechanical parts of the system according to the invention.

An embodiment of the invention will be described hereinbelow. Referring to FIG. 2 schematically showing the construction of the principal parts of the embodiment shown in FIG. 1, the basic construction of a carburetor 20 comprises, as known well, a float 1, a float chamber 2, a main jet 3, a fuel passage 4, an air bleeder pipe 6, an air nozzle 7, an air jet 8, a main nozzle 9, venturies 10 and 11, a throttle valve 12, a bypass hole 18, a low-speed hole 19, an adjusting screw 16, a low-speed jet 15, and a low-speed air bleeder 17. In this embodiment, an electromagnetic valve 27 is connected to the main jet 3 in the fuel measuring system of the carburetor 20 so that the effective area of the main jet 3 is controlled in response to the drive voltage generated from the electric control circuit 26. Numeral 24 designates a vehicle speed detector for detecting the running speed of the vehicle, and the vehicle speed detector 24 is attached to the speedometer cable take-off shaft of a transmission 25 of an engine 21. In this embodiment, other driving condition detectors than the vehicle speed detector 24 include an intake pressure detector 28 disposed in an intake manifold 22 to detect the pressure in the intake manifold, and an oxygen content detector 29 disposed in an exhaust manifold 23 to detect the oxygen content of exhaust gases, whereby the air-to-fuel ratio of the mixtures produced in the carburetor 20 is controlled by utilizing the vehicle speed, intake manifold pressure and exhaust gas oxygen content as control parameters. Numeral 30 designates a three-way catalytic converter.

Figure 3:
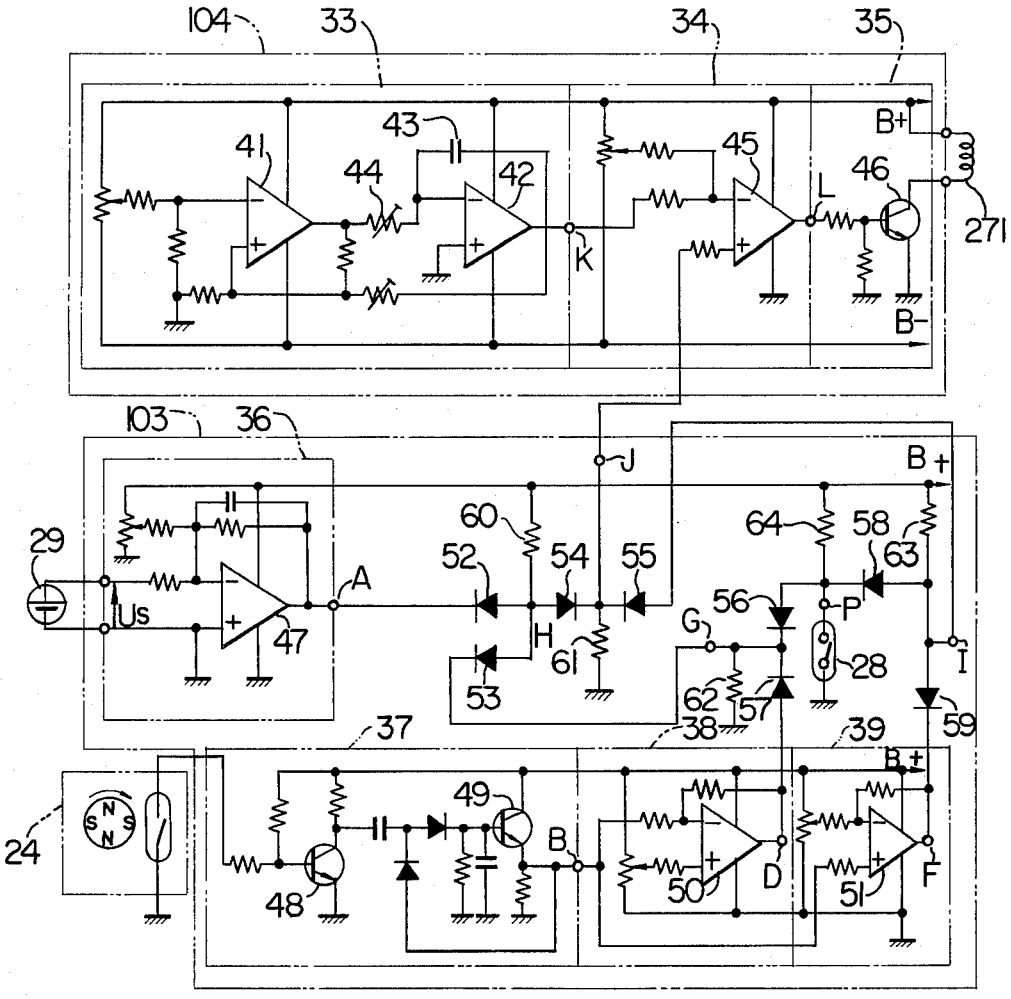
FIG. 3 is a wiring diagram showing a detailed construction of the electric circuit section of the system according to the invention.
Figure 4:
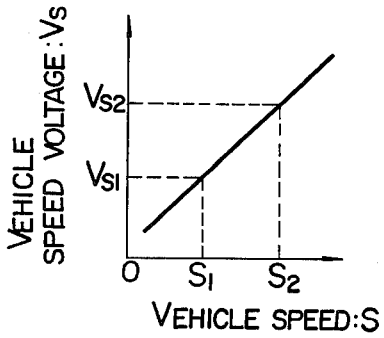
FIG. 4 is a vehicle speed voltage characteristic diagram.
Figure 5:
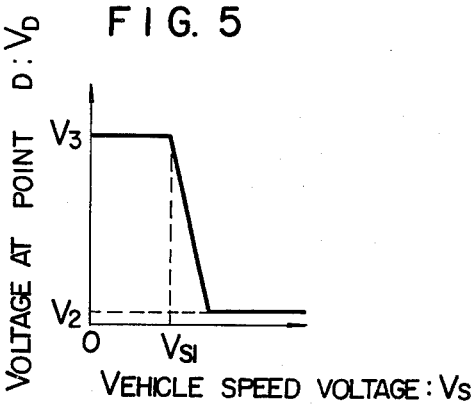
FIGS. 5 and 6 are vehicle speed function voltage characteristic diagrams.
Figure 6:
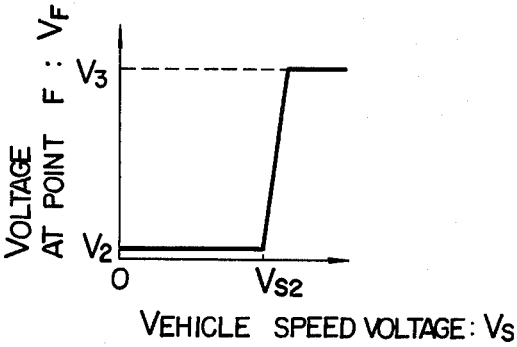

FIG. 3 illustrates a wiring diagram showing one form of the electric control circuit 26. In the Figure, numeral 103 designates the function voltage generator whose construction will be described hereinafter. Numeral 24 designates the vehicle speed detector comprising a rotary magnetic operatively associated with the speedometer cable take-off shaft of the vehicle transmission and a reed switch actuated by the rotary magnet, whereby a vehicle speed pulse signal having a frequency proportional to the vehicle speed is generated and it is then converted to a voltage by a known type of frequency-to-voltage converter 37 comprising transistors 48 and 49, etc., thereby generating at a point B a voltage or vehicle speed voltage proportional to the vehicle speed. This vehicle speed voltage characteristic is shown in FIG. 4, in which the abscissa represents the vehicle speed S km/h) and the ordinate represents the vehicle speed voltage $V_S$ at the point B. The vehicle speed voltage $V_S$ generated at the point B is applied as an input signal to two vehicle speed function voltage generators 38 and 39 respectively, including differential-type operational amplifiers 50 and 51. Consequently, the resulting function voltages generates at output points D and F of the vehicle speed function voltage generators 38 and 39 have the characteristics shown in FIGS. 5 and 6, in which the abscissal represent the vehicle speed voltage $V_S$ and the ordinates reperesents the function voltages $V_D$ and $V_F$ generated at the points D and F, respectively.

Figure 7:
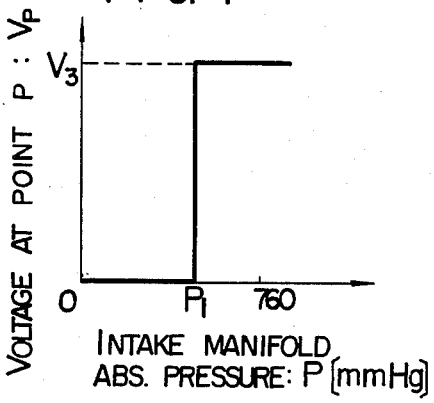
FIG. 7 is an intake manifold pressure function voltage characteristic diagram.

Numeral 28 designates the intake pressure detector disposed in the intake manifold 22 and comprising a pressure switch designed so that its contacts are closed when the intake manifold pressure P is equal to or lower than a preset value $P_1$, i.e., when $P \leqq P_1$, whereas the contacts are opened when the pressure P exceeds the preset value $P_1$, i.e., when $P > P_1$, and the detector 28 is connected to a resistor 64 at a point P to produce the pressure function voltage $V_P$ shown in FIG. 7. In the Figure, the abscissa represents the intake manifold absolute pressure P (mmHg) and the ordinate represents the pressure function voltage $V_P$ at the point P.

Figure 8:
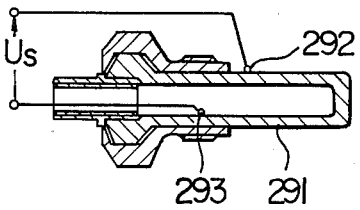
FIG. 8 is a sectional view showing the principal parts of an oxygen content detector.
Figure 9:
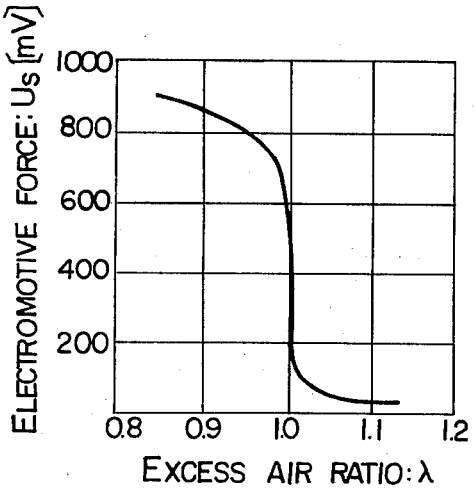
FIG. 9 is an output signal characteristic diagram of the oxygen content detector of FIG. 8.
Figure 10:
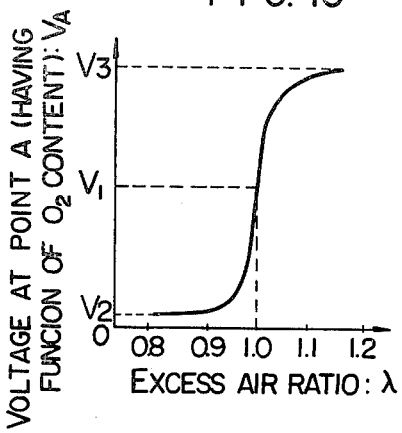
FIG. 10 is an oxygen content function voltage characteristic diagram.
Figure 11:
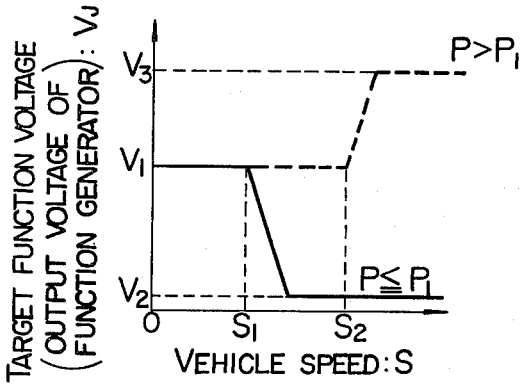
FIG. 11 is a target function voltage characteristic diagram.
Figure 12:
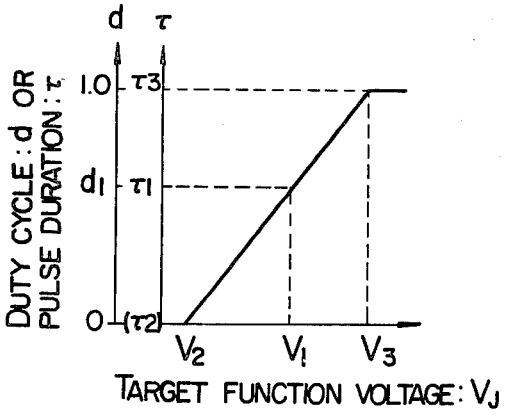
FIG. 12 is a pulse duration modulation characteristic diagram.
Figure 13:
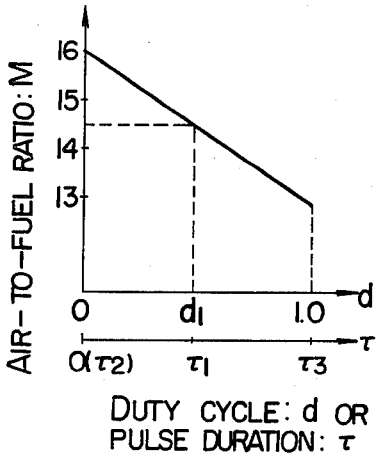
FIG. 13 is an air-to-fuel ratio variation characteristic diagram.

Numeral 29 desigantes the oxygen content detector, disposed in the exhaust manifold 23 which is constructed as shown in FIG. 8 by way of example. Namely, it comprises a sintered zirconia tube 291 having its inner and outer surfaces subjected to platinum surface treatment to produce catalytic action, and electrodes 292 and 293 between which is produced an electromotive force $U_S$ corresponding to the oxygen content in the exhaust gases. The electromotive force characteristic of the oxygen content detector 29 is shown in FIG. 9. In the Figure, the absicca represents the excess air ratio λ, namely, where the fuel used is gasoline the air-to-fuel ratio of 14.5 : 1 corresponds to $\lambda = 1$, and the ordinate represents the electromotive force $U_S$ produced between the electrodes 292 and 293. The oxygen content detection signal $U_S$ is applied as an input to an oxygen content function voltage generator 36 comprising a differential-type operational amplifier 47 which in turn produces at its output point A the oxygen content function voltage $V_A$ shown in FIG. 10. These function voltages are selectively passed through a selection circuit which generates a target function voltage $V_J$ for determining the air-to-fuel ratio. Diodes 56 and 57 and a resistor 62 constitute an upper limit selection circuit, whereby a greater one of the function voltages $V_D$ and $V_P$ is selected to produce a value $V_G$ at a point G. Diodes 52 and 53 and a resistor 60 constitute a lower limit selection circuit, whereby a smaller one of the function voltages $V_A$ and $V_G$ is selected to produce a value $_{VH}$ at a point H. Diodes 58 and 59 and a resistor 63 constitute another lower limit selection circuit, whereby a smaller one of the function voltages $V_F$ and $V_P$ is selected to produce a value $V_I$ at a point I. Diodes 54 and 55 and a resistor 61 constitute another upper limit selection circuit, whereby a greater one of the function voltages $V_H$ and $V_I$ is selected to produce a value $V_J$ at a point J. Thus, the resulting target function voltage $V_J$ produced at the point J has a pattern as shown in FIG. 11 in which the abscissa represents the vehicle speed S. In the Figure, the solid line indicates the pattern of the target function voltage $V_J$ obtained when the intake manifold vacuum P is lower than the preset value $P_1$ of the vacuum switch 28, and the dotted line indicates the similar pattern obtained when $P > P_1$. Numeral 104 designates the drive circuit which in this embodiment generates a timing pulse voltage at a predetermined repetition period which is independent of the engine rotational speed, and the time duration of this timing pulse is subjected to pulse-duration modulation in accordance with the target function voltage $V_J$ generated from the function voltage generator 103, thereby generating a drive voltage to actuate the electromagnetic valve 27. Numeral 33 designates a sawtooth wave generator comprising differential-type operational amplifiers 41 and 42, a capacitor 43 and a resistor 44. The sawtooth wave generator 33 includes a Schmitt configuration and an integrator configuration which are connected to each other to constitute a closed loop circuit, thus generating at a point K a sawtooth wave voltage of a predetermined frequency. Numeral 34 designates a comparator comprising a differential-type operational amplifier 45 which receives as its inverting input signal the sawtooth wave voltage generated at the point K and as its non-inverting input signal the target function voltage $V_J$ generated at the point J to generate at an output point L a timing pulse voltage having a frequency equal to the frequency of the sawtooth wave voltage at the point K and a pulse duration proportional to the target function voltage $V_J$ at the point J. Namely, the sawtooth wave generator 33 and the comparator 34 constitute a pulse duration modulator whose characteristic is shown in FIG. 12. In the Figure, the abscissa represents the modulating voltage, in this case, the target function voltage $V_J$ is used, and the ordinate represents the time duration $\tau$ of the timing pulse generated at the point L. Thus, since the repetition frequency of the sawtooth wave voltage at the point K is constant, the repetition frequency of the timing pulse at the point L is maintained at a predetermined value irrespective of the engine rotational speed. As a result, the ratio between the time duration and the repetition period of the timing pulse or duty cycle $d$ versus modulating voltage $V_J$ characteristic becomes as shown in FIG. 12. In the Figure, the ordinate represents the duty cycle $d$ and the abscissa represents the modulating voltage $V_J$. Consequently, the timing pulse at the point L is amplified by an amplifier 35 comprising a transistor 46, thereby producing a drive voltage for the electromagnetic valve 27. FIG. 2 shows one form of the electromagnetic valve 27 adapted for operation with the drive circuit shown in FIG. 3, in which when no timing pulse is applied to an exciting coil 271 of the electromagnetic valve 27, a moving core 272 is returned by a spring 273 and held in place by a stopper, with the result that the effective area of the main nozzle 3 in the carburetor 20 is decreased by a needle 274 coupled to the moving core 272, and the air-to-fuel ratio of the mixture produced in the carburetor 20 is increased, that is, the mixture is leaned out. On the other hand, when a timing pulse is applied to the exciting coil 271, the resulting electromagnetic attraction causes the moving core 272 and the needle 274 to move to the right, with the result that the effective area of the main nozzle 3 is increased, and the air-to-fuel ratio of the mixture produced in the carburetor 20 is decreased, that is, the mixture is enriched. Thus, since the repetition frequency of the timing pulse is selected so that the delay in the opening and closing operation of the electromagnetic valve 27 is negligible, the duration of opening of the electromagnetic valve 27 for every operating cycle thereof (the sum of the opening time and the closing time of the vavle) becomes equal to the ratio between the repetition period T and the time duration $\tau$ of the timing pulse or the duty cycle $d = \tau/T$ (in this case, the repetition frequency of the timing pulse must be determined by taking into consideration the response of the carburetor fuel supply system and the engine), and the air-to-fuel ratio M of the mixtures produced in the carburetor 20 decreases with increase in the duty cycle of the timing pulse. This relation is graphically represented in FIG. 13, in which the abscissa represents the pulse duration $\tau$ and the duty cycle $d$ of the timing pulse and the ordinate represents the air-to-fuel ratio M.

With the construction described above, the operation of this embodiment is as follows. When the vehicle speed is $S < S_1$, e.g., when the vehicle is running at relatively low speeds lower than about 50 km/h, the vehicle is in an exhaust gas purifying driving range or a range where the emission of harmful gases must be reduced as far as possible, and cleaner exhaust emission driving conditions are required. In this case, the lower limit voltage $V_2$ is selected as the function voltage $V_I$ while the function voltage $V_A$ is selected as the function voltage $V_H$. As a result, the function voltage $V_A$ is selected as the target function voltage $V_J$ irrespective of the intake manifold pressure P, since the greater one of the function voltages $V_H$ and $V_I$ *is selected to produce the value* $V_J$ at the point J. It should be noted here that in the present system the air-fuel mixture is controlled to have the stoichiometric air-to-fuel ratio, if the amount of fuel to be supplied to the engine is controlled only by the function voltage $V_A$. The reason for this is as follows. If the oxygen content detector 29 detects that the excess air ratio $\lambda$ of the mixture is larger than one, the function voltage $V_A$ become larger than the intermediate voltage $V_1$ and in turn the duty cycle $d$ is increased. When the duty cycle $d$ is increased, the amount of fuel to be supplied to the engine is increased, whereby the excess air ratio $\lambda$ is decreased. Thus, the function voltage $V_A$ is reduced to approach the voltage $V_1$. In a similar manner, when the function voltage $V_A$ is smaller than the voltage $V_1$, the duty cycle $d$ is decreased, whereby the excess air ratio $\lambda$ is increased. Thus, the function voltage $V_A$ is increased to approach the voltage $V_1$.

Figure 14:
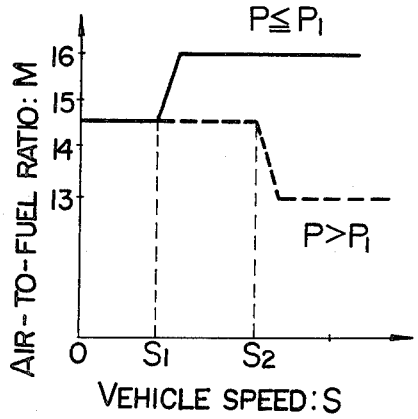
FIG. 14 is an air-to-fuel ratio control characteristic diagram.

Accordingly, the function voltage $V_J$ remains at the voltage $V_1$ when the function voltage $V_A$ is selected as the target function voltage $V_J$. Thus, the target function voltage $V_J$ is controlled at $V_J = V_1$ according to FIG. 11 and the timing pulse duty cycle $d$ is controlled at $d = d_1$ according to FIG. 12, thereby controlling the air-to-fuel ratio of the mixture with the carburetor air-to-fuel ratio $M = 14.5:1$ (air excess ratio $\lambda = 1$) as the desired value according to FIG. 13. This permits the three-way catalytic converter 30 to purify the harmful constituents, i.e., CO, HC and $NO_x$ in the exhaust gases with the maximum efficiency. With the vehicle speed $S > S_1$ and the intake manifold pressure $P \leqq P_1$, the vehicle is in the intermediate and high speed normal running range where the vehicle is driven at intermediate and high speeds requiring no large acceleration performance, and in this range reduction in the fuel consumption is required, thus making it desirable to drive the vehicle under economical fuel consumption driving conditions where the air-to-fuel ratio is increased. In this case, both the function voltages $V_G$ and $V_I$ have the voltage $V_2$. Thus, the smaller one of the function voltages $V_A$ and $V_G$, i.e., the voltage $V_2$ is selected as the function voltage $V_H$. Accordingly, the target function voltage $V_J$ has the voltage $V_2$ since both the function voltages $V_H$ and $V_I$ are the voltage $V_2$. Thus, $V_J = V_2$ is determined accordingly to FIG. 11, $d = 0$ according to FIG. 12 and $M = 16:1$ according to FIG. 13. Similarly, with the vehicle speed $S_1 < S < S_2$ and the intake manifold pressure $P < P_1$, the vehicle is in the intermediate speed and high power output driving range where both the moderate acceleration performance and fuel consumption economy are required and planned. In this case, both the functional voltages $V_G$ and $V_I$ have the voltage $V_1$. Accordingly the voltage $V_1$ is selected as the target function voltage $V_J$. Thus, $V_J = V_1$ is determined according to FIG. 11 and $d = d_1$ according to FIG. 12 and hence controlling the air-to-fuel ratio with $M = 14.5 : 1$ as a target ratio according to FIG. 13. The vehicle speed $S_2$ is determined at about 100 km/h. With the vehicle speed $S > S_2$ and the intake manifold pressure $P > P_1$, the vehicle is in the high speed and power output driving range where both the high speed and high acceleration performance are required, thus planning high power output driving conditions where the air-to-fuel ratio is decreased. In this case, the target function voltage has the upper limit voltage $V_3$ since the voltage $V_3$ is selected as the function voltage $V_I$. Thus, $V_J = V_3$ is determined according to FIG. 11, $d = 1.0$ according to FIG. 12 and hence $M = 13 : 1$ according to FIG. 13. Thus, FIG. 14 shows the resulting control pattern of the air-to-fuel ratio M (ordinate) which is provided by the carburetor 20, with the vehicle speed S (absicssa) and the intake manifold pressure P (parameter). Thus, the required characteristic for the engine is ensured to suit all the different driving conditions of the vehicle.

While, in the embodiment shown by the wiring diagram of FIG. 3, three different detectors are used as the required driving condition detectors, it is possible to use various detectors for detecting the amount of air drawn into the engine, engine rotational speed, engine temperature, pressure, etc., and using the resulting outputs as the additional control parameters to produce the target function voltage and thereby control the air-to-fuel ratio.

Figure 15:
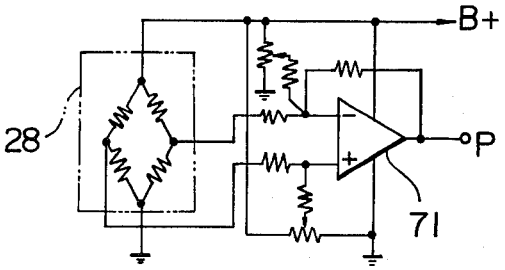
FIG. 15 is a wiring diagram showing another construction of the intake manifold pressure function voltage generator.
Figure 16:
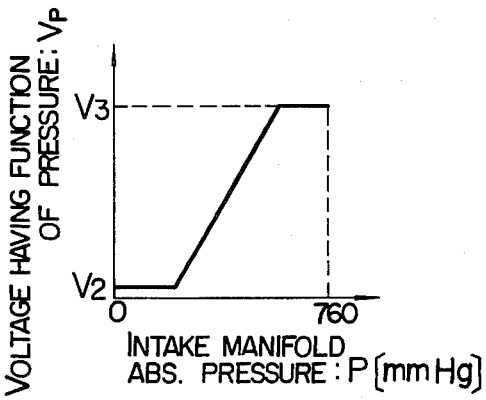
FIG. 16 is an intake manifold pressure function voltage characteristic diagram.
Figure 17:
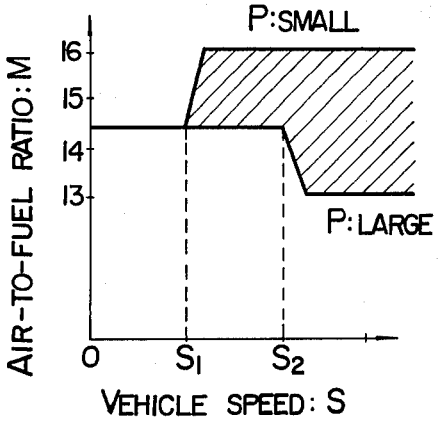
FIG. 17 is an air-to-fuel ratio control characteristic diagram.

Further, while, the intake pressure detector 28 shown in FIG. 3 comprises a pressure switch whose output changes in a stepwise manner at the preset pressure $P_1$, it is possible to use for example a semiconductor pressure transducer to detect continuously the pressure in the intake manifold. FIG. 15 illustrates a wiring diagram showing one form of such pressure transducer, in which numeral 28 designates a semiconductor pressure transducer, 71 a differential-type operational amplifier for amplifying the transducer output signal to produce a pressure function voltage $V_P$. The resulting intake pressure function voltage characteristic is shown in FIG. 16, in which the ordinate represents the intake pressure function voltage $V_P$ and the abscissa represents the intake manifold pressure P. FIG. 17 shows the air-to-fuel ratio control characteristic obtained by using this pressure function voltage generating circuit in place of the intake pressure detector 28 of FIG. 3 comprising a pressure switch, and consequently the intake manifold pressure changes continuously from small to large values, thus making it possible to continuously control the air-to-fuel ratio throughout the range of the two solid lines and the hatched line defined by the former and thereby accomplishing finer control of the air-to-fuel ratio.

Figure 18:
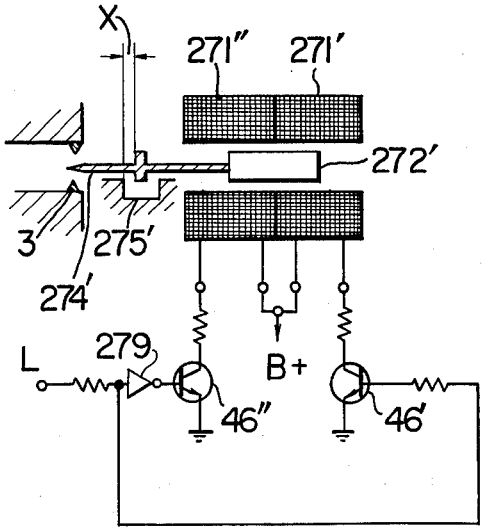
FIG. 18 is a schematic diagram showing another detailed construction of the electromagnetic valve.
Figure 19:
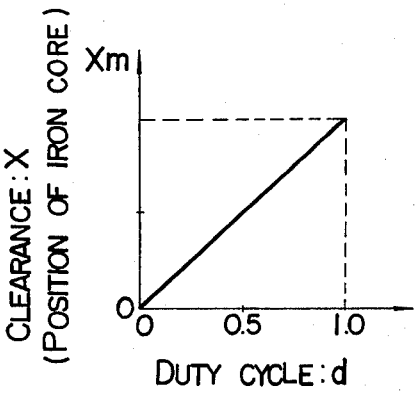
FIG. 19 is a characteristic diagram of the electromagnetic valve shown in FIG. 18.
Figure 20:
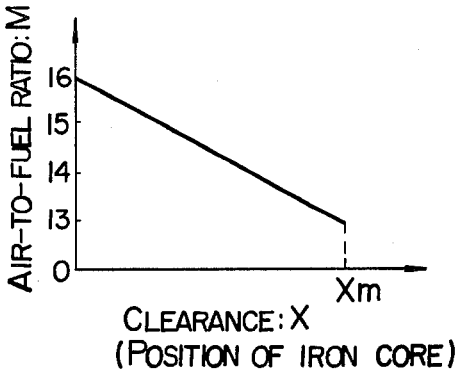
FIG. 20 is a position X versus air-to-fuel ratio M characteristic diagram.

Referring now to FIG. 18, there are shown another embodiment of the electromagnetic valve 27 and the amplifier circuit 35 of the drive circuit adapted for use with this electromagnetic valve. The electromagnetic valve comprises a moving core 272' centrally disposed between a pair of exciting coils 271' and 271'', and a needle 274' coupled to the moving core 272' to vary the effective area of the carburetor main jet 3, whereby the exciting currents for the pair of exciting coils 271' and 271'' are supplied by the collector currents of transistors 46' and 46''. The base of the transistor 46'' is connected through the inverter 279 to the terminal L of the pulse modulator of FIG. 3, and the base of the transistor 46' is connected to the point L. Consequently, the "on" time of the transistor 46' is equal to the timing pulse duration $\tau$, and the "on" time of the transistor 46'' is equal to the "off" period of the timing pulse, with the result that the average current in the exciting coil 271' is proportional to the timing pulse duty cycle d, and the average current in the exciting coil 271'' is proportional to (1-d). If the characteristics of the exciting coils 271' and 271'' are symmetrical, a magnetic attraction is produced whose magnitude is represented by the effective core position in the exciting coils and the average value of the exciting currents. Thus, if the moving core position is shown in terms of its distance X from a stopper means 275', then the moving core position or the distance X is determined in accordance with the duty cycle of the timing pulse as shown in FIG. 19. As a result, when $d = 0$, then $X = 0$ and the effective area of the main jet 3 is reduced to a minimum, while when $d = 1.0$, then $X = X_m$ and the effective area of the main jet 3 is increased to a maximum. FIG. 20 shows the resulting control characteristic of the air-to-fuel ratio M in the carburetor 20 in relation to the position X. Thus, by replacing the amplifier circuit 35 in the wiring diagram of FIG. 3 by the circuit shown in FIG. 18, it is possible to control the air-to-fuel ratio in the carburetor in the previously mentioned manner with the electromagnetic valve shown in FIG. 18.

Figure 21:
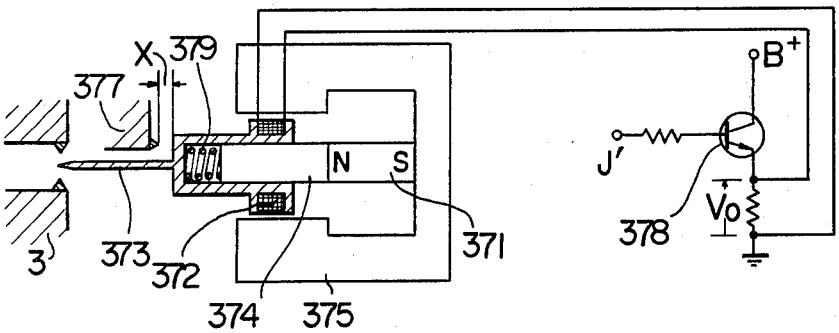
FIG. 21 is a schematic diagram showing still another construction of the electromagnetic valve.
Figure 22:
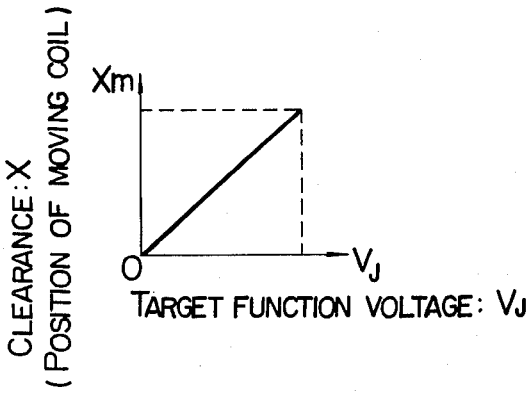
FIG. 22 is a characteristic diagram of the electromagnetic valve shown in FIG. 21.

FIG. 21 shows still another embodiment of the electromagnetic valve 27. In the Figure showing an example of moving coil type electromagnetic valve, a moving coil 372 is disposed in the gap of a magnetic path formed by a permanent magnet 371 and yokes 374 and 375, and a needle 373 is coupled to the moving coil 372 to vary the effective area of the carburetor main nozzle 3. In the Figure, numeral 377 designates a stopper, 378 an amplifying transistor constituting an emitter follower circuit, 379 a spring. FIG. 22 shows variation of the position X of the moving coil 372 in relation to the voltage $V_J$ applied to a signal input terminal J' of the amplifying transistor 378. Also, the resulting control characteristic of the air-to-fuel ratio M in the carburetor 20 in relation to the position X is the same as shown in FIG. 20. Thus, by connecting the terminal J' to the function voltage generating terminal J of the function voltage generator 103 of FIG. 3, it is possible to cause the exciting current to flow in the moving coil 372 in proportion to the function voltage $V_J$, thus making it possible to control the effective area of the main jet and thereby control the air-to-fuel ratio in the similar manner as mentioned previously.

While, in the above-described embodiment, the electromagnetic valve is mounted on the carburetor in a manner that it acts on the main jet of the carburetor, it is possible to cause the electromagnetic valve to act on any component part of the fuel measuring system of the carburetor. For example, it is possible to cause the electromagnetic valve to act on any of the fuel passage 4, the air bleeder pipe 6, the air nozzle 7, the air jet 8 and the main nozzle 9, or alternately a separate fuel measuring system for the electromagnetic valve may be disposed in the conventional fuel measuring system of the carburetor.

Further, while the carburetor shown in FIG. 2 is of the single barrel type, the air-to-fuel ratio may be controlled similarly by mounting an electromagnetic valve in either one or both of the primary fuel measuring system and the secondary fuel measuring system of a two-barrel carburetor in the similar manner as mentioned previously.

Furthermore, while, in the above-described embodiment, the effective area of the main jet in the fuel measuring system of the carburetor is controlled by the electromagnetic valve 27 in response to the function voltage $V_J$ from the function voltage generator 103, the air-to-fuel ratio of the mixtures supplied to a vehicle mounted internal combustion engine may be controlled by such means which for example controls the pressure in the carburetor float chamber or the amount of air supplied into the carburetor.

What is claimed is:

1. An air-to-fuel ratio control system for internal combustion engines comprising:

a carburetor, provided in the intake passage of an engine of a vehicle, for supplying said engine with air-fuel mixture, said carburetor including a float chamber in which fuel is stored, a venturi at which said fuel is mixed with air, and a fuel passage which communicates said float chamber with said venturi;

a speed detector for generating a first signal indicative of the vehicle speed;

an air-to-fuel ratio detector, provided in the exhaust passage of said engine, for generating a second signal related to the air-to-fuel ratio of said mixture supplied to said engine;

a pressure detector, provided in said intake passage, for generating a third signal indicative of the pressure in said intake passage;

a frequency-to-voltage converter circuit connected to said speed detector, for generating a fifth voltage signal whose voltage corresponds to the frequency of said first signal;

a first vehicle-speed function voltage generator connected to said frequency-to-voltage converter circuit, for generating a sixth voltage signal related to the comparison of said fifth voltage signal to a first predetermined level;

a second vehicle-speed function voltage generator connected to said frequency-to-voltage converter circuit, for generating a seventh voltage signal related to the comparison of said fifth voltage signal to a second predetermined level;

a first logical circuit connected to said first vehicle-speed function voltage generator and said pressure detector, for generating a first logical output signal from said second sixth signal and said third signal;

a second logical circuit connected to said second vehicle-speed function voltage generator and said pressure detector, for generating a second logical output signal from said seventh voltage signal and said third signal;

a third logical circuit connected to said first logical circuit and said air-to-fuel ratio detector, for generating a third logical output signal from said first logical output signal and said second signal; and a fourth logical circuit connected to said second and third logical circuits, for generating a fourth signal by logical operation on said second and third logical output signals so that said fourth signal corresponds to said second signal when the speed of said vehicle is less than a first predetermined value, to one of said second and third signals when the speed of said vehicle is between said first value and a second predetermined value greater than said first value and to said third signal when the speed of said vehicle is greater than said second value; and electromagnetic valve means, connected to said function signal generator and provided in said fuel passage, for controlling the amount of fuel flowing therethrough in response to said fourth signal, whereby the air-to-fuel ratio of said mixture is switched in response to said speed of said vehicle.

2. An air-to-fuel ratio control system as set forth in claim 1, wherein each of said first, second, third and fourth logical circuits includes at least two diodes.

3. An air-to-fuel ratio control system as set forth in claim 1 wherein:

said electromagnetic valve means includes:

a moving core having a needle valve portion which moves to control the amount of fuel flowing through said fuel passage, and first and second exciting coils electromagnetically coupled to said moving core, the needle valve portion of said moving core being moved in one direction to increase the amount of fuel upon the energization of said first exciting coil, and being moved in the other direction to decrease the amount of fuel upon the energization of said second exciting coil; and said system further comprises:

a pulse generator, connected between said electromagnetic valve means and said function signal generator, for generating a pulse signal having a fixed frequency and a time duration which varies in response to said function signal, said pulse signal controlling said electromagnetic valve means, said pulse generator including first and second energizing circuits connected to said first and second exciting coils, respectively, for alternately energizing said first and second exciting coils in response to said pulse signal, whereby the position of said moving core being varied in accordance with the duty cycle of one of said energizing means.

4. An air-to-fuel ratio control system as set forth in claim 1, wherein said pressure detector includes mechanical switch means which is actuated at a predetermined level of pressure.

5. An air-to-fuel ratio control system as set forth in claim 1, wherein said pressure detector includes a pressure sensitive semiconductor for generating an output signal, in analog form, corresponding to the pressure in said intake passage.

6. An air-to-fuel ratio control system for internal combustion engines comprising:

a carburetor, provided in the intake passage of an engine of a vehicle, for supplying said engine with air-fuel mixture, said carburetor including a float chamber in which fuel is stored, a venturi at which said fuel is mixed with air, and a fuel passage which communicates said float chamber with said venturi;

a speed detector for generating a first signal indicative of the vehicle speed;

an air-to-fuel ratio detector, provided in the exhaust passage of said engine, for generating a second signal related to the air-to-fuel ratio of said mixture supplied to said engine;

a pressure detector, provided in said intake passage, for generating a third signal indicative of the pressure in said intake passage;

a function signal generator, connected to said detectors, for generating a fourth signal related to said second signal when the speed of said vehicle is less than a first predetermined value, to one of said second and third signals when the speed of said vehicle is between said first value and a second predetermined value, greater than said first value and to said third signal when the speed of said vehicle is greater than said second value;

magnetic path forming means having a permanent magnet;

a moving core having a needle valve portion which moves to control the amount of fuel flowing through said fuel passage, said moving core mounting an exciting coil thereon;

spring means connected to said magnetic path forming means and said moving core, for biasing said moving core; and current control means connected between said function signal generator and the exciting coil mounted on said moving core, for controlling a current to said exciting coil in proportion to the voltage of said fourth signal.

7. In an automotive vehicle driven by an internal combustion engine having a carburetor for supplying air-fuel mixture, an air-to-fuel ratio control system comprising:

a plurality of condition detectors for detecting the operating conditions of said engine, respectively;

a speed detector for detecting the travelling speed of said vehicle;

a function generator connected to said condition detectors and said speed detector for generating an output according to first and second functions when said travelling speed of said vehicle is lower and higher than a predetermined speed, respectively, said first function related to at least one of said operating conditions of said engine and said second function related to at least one of said operating conditions of said engine different from said at least one of said operating conditions related to said first function;

a pulse generator connected to said function generator for generating a train of pulse signals at a fixed frequency, each of said pulse signals having respective time intervals proportional to said function output;

a needle valve positioned in said carburetor for controlling the air-to-fuel ratio of air-fuel mixture supplied to said engine in proportion to the position thereof; and electromagnetic means having a movable core secured to said needle valve and a first and second exciting coils arranged longitudinally such that said movable core is moved therethrough, longitudinally such that said movable core is moved therethrough, said first and second coils being connected to said pulse generator to be energized in response to the presence and the absence of said pulse signals, respectively for controlling the position of said movable core in proportion to said time intervals of said pulse signals.

8. An air-to-fuel ratio control system according to claim 7, wherein said carburetor includes a float chamber in which fuel is stored, a venturi at which said fuel is mixed with air and a fuel passage which communicates said float chamber with said venturi, and wherein said needle valve is positioned in said fuel passage to control the amount of fuel flowing from said float chamber to said venturi.

9. An air-to-fuel ratio control system according to claim 8, wherein said condition detectors includes an air-to-fuel ratio detector for detecting the air-to-fuel ratio of air-fuel mixture supplied to said engine in response to the oxygen concentration in the exhaust gases and a pressure detector for detecting the pressure in the intake manifold of said engine, and wherein said first function is related to said air-to-fuel ratio detected by said air-to-fuel ratio detector and said second function is related to said pressure detected by said pressure detector.

* * * * *